US006253832B1

(12) United States Patent
Hallefält

(10) Patent No.: US 6,253,832 B1
(45) Date of Patent: Jul. 3, 2001

(54) DEVICE FOR CASTING IN A MOULD

(75) Inventor: Magnus Hallefält, Ängelholm (SE)

(73) Assignee: Asea Brown Boveri AB, Vasteras (SE)

( * ) Notice: Subject to any disclaimer, the term of this patent is extended or adjusted under 35 U.S.C. 154(b) by 0 days.

(21) Appl. No.: 09/117,266

(22) Filed: Jul. 27, 1998

(51) Int. Cl.[7] ..... B22D 27/02
(52) U.S. Cl. ..... 164/502; 164/466
(58) Field of Search ..... 164/466, 502, 164/468, 504

(56) References Cited

U.S. PATENT DOCUMENTS

| | | | |
|---|---|---|---|
| 5,332,027 | 7/1994 | Kageyama et al. | 164/502 |
| 5,613,548 | 3/1997 | Streubel et al. | 164/502 |

FOREIGN PATENT DOCUMENTS

WO 9416844 8/1994 (WO) .

*Primary Examiner*—Kuang Y. Lin

(74) *Attorney, Agent, or Firm*—Dykema Gossett PLLC

(57) ABSTRACT

A device, for continuously or semicontinuously casting of metal in a casting mould, for braking and splitting up a primary flow of hot melt supplied to a casting mould, and controlling the flow of melt in the non-solidified portions of a cast strand which is formed in the casting mould. The device comprises a plurality of water box beams which support and cool the casting mould and supply a coolant to the casting mould, and a magnetic brake. The magnetic brake is adapted to generate at least one static or periodic low-frequency magnetic field to act in the path of the inflowing melt and comprises at least one magnet to generate the magnetic field, at least one core to transmit the magnetic field to the casting mould and a cast strand, and at least one magnetic return path to close the magnetic circuit. The water box beam is completely or partially arranged in a magnetically conducting material. A magnetic brake comprises at least one magnetic circuit which comprises the casting mould and the cast strand into a magnetic circuit. The magnet is arranged in a recess in a water box beam. The magnet and the magnetic return path are integrated so that the magnet and the magnetic return path are arranged inside the rear wall of the water box beam.

14 Claims, 2 Drawing Sheets

DEVICE FOR CASTING IN A MOULD

TECHNICAL FIELD

The present invention relates to a device, during continuous or semicontinuous casting of metal in a mould which is cooled and open in both ends of the casting direction, of braking and dividing a primary flow of hot melt supplied to a casting mould included in the mould, and controlling the flow of melt in the non-solidified portions of a cast strand which is formed in the casting mould by means of at least one static or periodic low-frequency magnetic field. The static or periodic low-frequency magnetic field is applied by means of a magnetic brake.

BACKGROUND ART

During a continuous or semicontinuous casting process for metals or their alloys, such as during continuous casting of steel, a hot melt is supplied to a casting mould which is part of a mould. In this application, mould means a casting mould, in one or more parts, for forming a cast strand of melt supplied to the mould and water box beams arranged around the casting mould. The casting mould, which is cooled and open in both ends of the casting direction, usually comprises cooled copper plates but may be made from another material with suitable thermal, electrical, mechanical and magnetic properties. The task of the water box beam is partly to stiffen and support the copper plate and partly to cool it and to conduct a coolant, such as water, to the mould. To make possible variation of the dimensions of the cast strand, the water box beams and the copper plates included in the casting mould are movable along an axis which is perpendicular to the casting direction. In the casting mould, the melt is cooled and formed into a cast strand. When leaving the casting mould, the cast strand comprises a solidified self-supporting surface layer which surrounds a liquid core of non-solidified melt. If inflowing melt is allowed to flow in an uncontrolled manner into the casting mould, it will penetrate deep down into these non-solidified portions of the cast strand. This makes the separation of unwanted particles, contained in the melt difficult. In addition, the self-supporting surface layer is weakened, which increases the risk of melt breaking through the surface layer formed in the casting mould.

From, for example, Swedish patent specification SE-PS 436 251, it is known to generate, by means of magnetic-field generating and magnetic-field transmitting devices, one or more static or periodic low-frequency magnetic fields and to apply these to act in the path of the melt to brake and distribute the inflowing melt. The magnetic-field generating and magnetic-field transmitting means are usually referred to as magnetic brakes and are used to a large and increasing extent in continuous casting of steel, preferably in continuous casting of coarser steel blanks such as slabs, that is, blanks with a large, essentially rectangular cross section, and blooms, that is, blanks with a large, essentially square cross section.

However, the method and the devices can also be used in casting of smaller blanks, that is, billets, with a small, essentially square cross section, as well as in casting of non-ferrous melts, such as slabs and extrusion billets of aluminium and copper as well as alloys based on these metals in semicontinuous processes.

The cast strand is formed by cooling and forming the melt supplied to the casting mould in the casting mould and continuing the cooling after the cast strand has left the casting mould. The casting mould is open in both ends of the casting direction and comprises walls, which usually comprise four separate copper plates. The copper plates are cooled during the casting. The copper plates are each fixed to a water box beam. The task of the water box beam is partly to stiffen and support the copper plate and partly to cool it and to conduct a coolant such as water to the casting mould. To make possible variation of the dimensions of the cast strand, the water box beams and the copper plates are movable along an axis which is perpendicular to the casting direction. Magnetic brakes are used both during closed casting, that is, when melt is supplied to the casting mould through a casting pipe with an arbitrary number and arbitrarily directed openings of the casting pipe opening out into the melt below the meniscus, and during open casting, that is, when melt is supplied to the casting mould from a container, a ladle or tundish, by means of a free tapping jet which hits the meniscus.

According to Swedish patent specification SE 91 00 184-2, a magnetic brake comprises means for generating and transmitting a static or periodic low-frequency magnetic field to act on non-solidified portions of a cast-strand. The magnetic-field generating means are permanent magnets and/or electromagnets, that is, coils with magnetic cores supplied with current. These magnetic-field generating means will hereinafter in this application be referred to as magnets. A magnetic brake comprises, in addition to magnets and cores, also magnetic return paths which close the magnetic circuits in which the magnets are arranged such that one or more closed magnetic circuits with flux balance are obtained close to a mould. These closed circuits comprise magnets, cores and a magnetic return path arranged close to the cores as well as a cast strand with melt present in the casting mould. One or more magnets are arranged on two opposite sides of the casting mould. In case of casting moulds with a rectangular cross section, the magnets are usually arranged along the long sides of the casting mould. Cores are arranged to transmit the magnetic field generated by the magnets to the casting mould and the cast strand present in the casting mould. According to the prior art, the magnets are placed outside the water box beam and must therefore be conducted through the water box beam by means of the core in order to reach the melt. According to the prior art, this is achieved with a core of magnetic material in one ore more pieces extending through the water box beam up to the wall of the casting mould. In those cases where energized electromagnets are used to generate the magnetic field, the coils of the magnets surround the magnetic core and are placed outside the water box beam.

In a continuous casting plant with a magnetic brake arranged and placed according to the prior art, the magnetic field is generated by magnets which are arranged outside the water box beams and is transmitted by means of cores to the casting mould. The length of the cores, which at least corresponds to the width of the water box beams, gives rise to magnetic losses. The losses, in turn, mean that the magnets have to be made larger. When using electromagnets supplied with current, this means that a higher electrical energy is needed to achieve the desired field strength in the melt. During the continuous casting, it is important that the melt does not adhere to the casting mould. For this reason, an oscillating motion in the casting direction is imparted to the casting mould during the casting by means of a shaking table, on which the casting mould, the water box beams and the magnetic brake rest. The larger the mass to be oscillated, the more energy is required. Therefore, it is desirable to limit the mass and the size of the casting mould, the water box beam and the magnetic brake. According to the prior art relating to magnetic brakes and to installation of magnetic brakes, at least the magnets and essential parts of the magnetic return paths are arranged outside the water box beams. In this way, it is difficult to obtain any significant reduction of the mass of the magnetic brake. Thus, it has not been possible to achieve the desired reduction of the required size and mass of a magnetic brake according to the prior art.

In addition, a possible frame structure, which is often arranged to support the casting mould and water box beams, must be further extended to provide space also for the parts of a magnetic brake which are arranged outside the water box beams.

One object of the invention is, therefore, to suggest a magnetic brake which has a reduced size and mass relative to electromagnetic brakes according to the prior art and an installation of this magnetic brake close to a mould which reduces the size and mass of the total installation while observing and fulfilling the metallurgical requirements for a magnetic brake. It is also an essential object of the present invention to reduce the total length of the cores included in the magnetic brake, whereby considerably less energy will be required both during oscillation of a casting mould with an associated electromagnetic brake and during magnetization of the magnets included in the electromagnetic brake.

SUMMARY OF THE INVENTION

The invention relates to a device, for continuous or semi-continuous casting of metal in a casting mould which is cooled and open in both ends of the casting direction, for braking and splitting up a primary flow of hot melt supplied to the casting mould and controlling the flow of melt in the non-solidified portions of a cast strand which is formed in the casting mould, by means of a static or periodic low-frequency magnetic field. The static or periodic low-frequency magnetic field is applied by means of a magnetic brake. The cooled casting mould is open in both ends of the casting direction and is provided with means for cooling melt supplied to the casting mould and forming this melt into a cast strand. Preferably, the casting mould comprises four cooled copper plates, which are retained into a cooled casting mould by the water box beams arranged around the casting mould. The device comprises a plurality of water box beams and a magnetic brake. The water box beams are arranged outside and surrounding the casting mould to support and cool the casting mould and to supply a coolant, preferably water, to the casting mould. The magnetic brake is adapted to generate at least one static or periodic low-frequency magnetic field to act in the path of the inflowing melt to brake and split up a primary flow of hot melt supplied to the casting mould and control the secondary flow of melt, thus arisen, in the non-solidified portions of a cast strand which is formed by cooling of a melt. The magnetic brake comprises at least one magnetic circuit. Each magnetic circuit comprises at least one magnet, one core and one magnetic return path and the casting mould and the cast strand and/or melt present in the casting mould. The magnet may be a permanent magnet or an electromagnet, that is, an energized coil with a magnetic core of a magnetically conducting material. The magnet generates the static or period low-frequency magnetic field. The core, which may be whole or be composed of several parts, is made of a magnetically conducting material and transmits the magnetic field generated by the magnet to the casting mould and the cast strand present in the casting mould. In electromagnetic brakes, that is, brakes with magnets in the form of electromagnets, the magnetic core usually constitutes part of the core. The magnetic return path closes the magnetic circuit. The magnetic return path is usually referred to as a yoke.

Since the water box beam comprises-magnetically conducting material and since the part of the water box beam made of magnetic material is included in the magnetic return path and/or the core while at the same time the magnet is arranged in a recess in a water box beam, the objects of the invention are fulfilled since the magnet and the magnetic return path are integrated in the water box beam in such a way that the magnet and the magnetic return path in their entirety are housed and placed inside the rear wall of the water box beam.

The magnetic return path and the core are part of a magnetic brake. The invention eliminates the need of an externally disposed magnetic yoke. According to the constructively advantageous and compact design where, according to the invented device, the magnet/magnets are arranged in their entirety inside the water box beam and since part of the water box beam is designed to be part of a magnetic return path, a magnetic brake is obtained where those parts of the magnetic brake, which according to the prior art were arranged outside the water box beam, are completely eliminated. The size and mass of the magnetic brake are considerably reduced in this compact design. The core is considerably shortened and the external separate magnetic yoke is replaced by a part of the water box beam made of a magnetically conducting material.

A device comprising a compact magnetic brake integrated with the water box beam into an advantageous compact installation is advantageous in relation to a magnetic brake according to the prior art. A magnetic brake, designed and integrated according to the prior art, has significant parts, at least magnets and a magnetic return path and in certain cases also parts of the core, arranged outside the water box beam and connected to the casting mould by means of a long core. A great advantage with a compact magnetic brake integrated with the water box beam according to the invention is the considerably reduced mass and size of the magnetic brake. In this way, the total mass and size of the brake and the mould have been considerably reduced. The reduces the energy requirement for the mould oscillation, which is necessary for reasons of casting engineering, and the need of a supporting frame around the mould and the magnetic brake. In moulds where a frame is built around the mould, this of course means that loads and stresses on the frame are decreased.

According to one embodiment of the invention, which is made possible by the compact design where the magnetic brake has been integrated with the water box beam, no separate cooling system is needed for cooling the magnetic brake but the brake is cooled by means of the cooling devices which are arranged for cooling the mould and the cast strand formed in the casting mould. The magnetic brake is preferably cooled by the water flowing in the water box beams for cooling the mould. The elimination of a separate cooling system for the magnetic brake further reduces the total mass for a mould with a magnetic brake.

The length of a core in a compact magnetic brake, which according to the invention is integrated with the water box beams, is considerably shorter than the length of the cores in a brake according to the prior art. The considerably shorter core length reduces the magnetic losses in the core such that less magnetic force is required for generating a magnetic field with the desired field strength in the cast strand. When using electromagnets supplied with current, this means that lower electrical energy is needed to achieve the desired magnetic field strength in the melt than for a magnetic brake according to the prior art.

In certain embodiments of magnetic brakes, usually called electromagnetic brakes, the magnet is an electromagnet supplied with electric direct current or low-frequency alternating current. The electromagnet comprises a coil supplied with direct current, arranged around a magnetic core of a magnetically conducting material. During passage of current, the coil induces a magnetic field in the magnetic core. As previously described, the magnetic core constitutes part of or is connected to the core included in the brake, whereby the magnetic field induced in the magnetic core is transmitted via the core to the casting mould and the cast strand present in the casting mould. For an electromagnetic brake which according to the invention is integrated with the water box beams, a part of the water box beams, which is made of a magnetic material, is included in the magnetic return path. To obtain the advantageous compact design, the energized coil is arranged in a recess in the water box beam or alternatively between the water box beam and the casting mould.

To influence the propagation, direction and field strength of the magnetic field in the melt, it is advantageous to arrange plates in connection with both the wall and the core of the casting mould. The plates, which completely or partially consist of magnetic material, are often called pole plates and are adapted to influence the propagation and strength of the magnetic field in the casting mould and the cast strand and/or melt present in the casting mould. In certain embodiments, the pole plates are made completely of a magnetic material and with a cross section in the axial direction of the core, usually across the casting direction, which deviates from the cross section of the core. In alternative embodiments, the pole plate is arranged with sections of a magnetic material and sections of a non-magnetic material, the sections of magnetic material constituting magnetic windows for control of the propagation, the direction and the magnetic field strength of the magnetic field in the casting mould and the cast strand and/or melt present in the casting mould. In embodiments where the magnets are arranged in recesses in the water box beams, the pole plates are arranged with one of their sides detachably connected to the water box beam and with the opposite side connected to the copper plate. Preferably, one pole plate is detachably attached to a copper plate by means of bolts. The magnet according to these embodiments is arranged in such a way in the water box beams that, when removing a pole plate, the magnet positioned inside is exposed. The propagation and strength of the magnetic field in the casting mould and the cast strand and/or melt present in the casting mould are also influenced by introducing magnetic sections in the casting mould, according to certain embodiments, which is usually made of a non-magnetic material such as copper.

According to a further embodiment of the invention, a core included in a magnetic brake which is designed and integrated with the water box beam according to the invention, is arranged sectioned in its axial direction. The core comprises axially oriented sections of magnetic material and axially oriented sections of non-magnetic material, at least some of these core sections being detachably arranged to achieve a change of the propagation and strength of the magnetic field in the core, by changing the configuration of the sections, thereby controlling the propagation, the direction and the magnetic field strength of the magnetic field in the casting mould and the cast strand and/or melt present in the casting mould. For an electromagnetic brake, also the magnetic core arranged in the coil may be sectioned.

The invention is especially advantageous in magnetic brakes where a plurality of magnets are adapted to generate static or periodic low-frequency magnetic fields to act at at least two levels within the casting mould since the number of magnets and the amount of magnetic material in the cores in these cases become considerable in magnetic brakes according to the prior art, which entails both a large mass of the mould and the magnetic brake and a large core length with considerable magnetic losses between the magnet and the casting mould. For the same reasons, the compact magnetic brake, which according to the invention is integrated with the water box beams, also opens for advantageous installations where magnetic brakes comprising a plurality of magnets are adapted to generate two or more static or periodic low-frequency magnetic fields to act at the same level across the casting direction in a casting mould.

It is especially advantageous to use a device according to the invention to generate static or periodic low-frequency magnetic fields to act at two levels within a casting mould during closed casting. By closed casting is meant that melt is supplied to the casting mould through a casting pipe with one or more openings opening out below the upper surface of the melt—the meniscus. Depending on other parameters such as the dimensions of the cast strand, the casting speed, any gas flow supplied for various reasons to the primary flow of supplied melt in the casting pipe, these magnetic fields are placed at different levels relative to the meniscus and the openings of the casting pipe to achieve secondary flows in the mould, preferably circulating secondary flows which ensure a good separation of any particles entering with the steel, good thermal conditions in the cast strand to ensure the desired casting structure. The use of different alternative locations of the magnets is described in more detail below in the embodiments with reference to FIGS. 3 and 4.

BRIEF DESCRIPTION OF THE DRAWINGS

In the following the invention will be described in greater detail and be exemplified by means of preferred embodiments with reference to the accompanying figures and examples of use.

DESCRIPTION OF THE PREFERRED EMBODIMENTS

Figure 1:
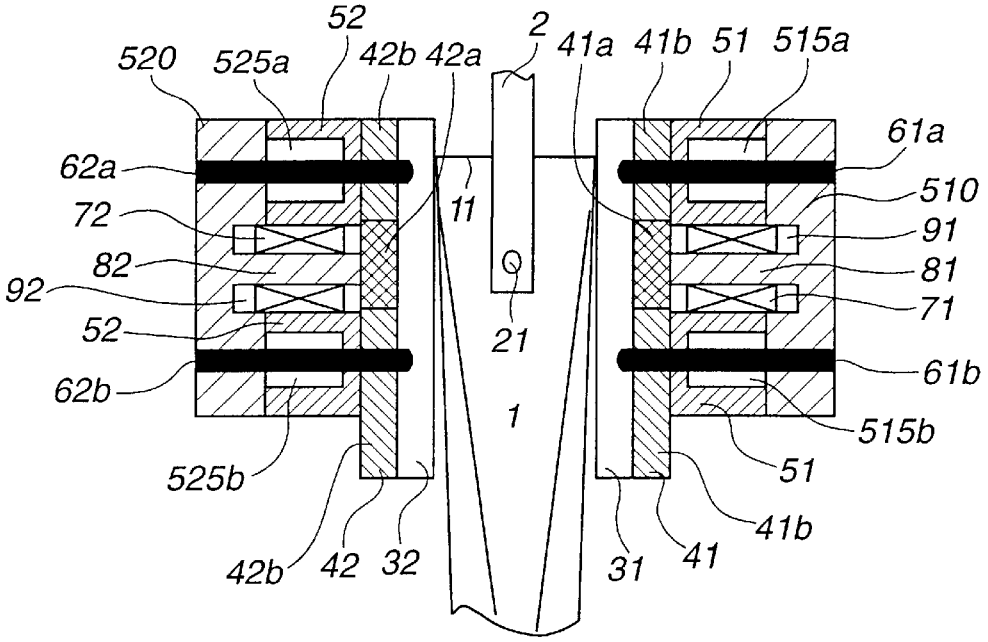
FIG. 1 shows a schematic vertical cross section through one embodiment of the device.
Figure 2:
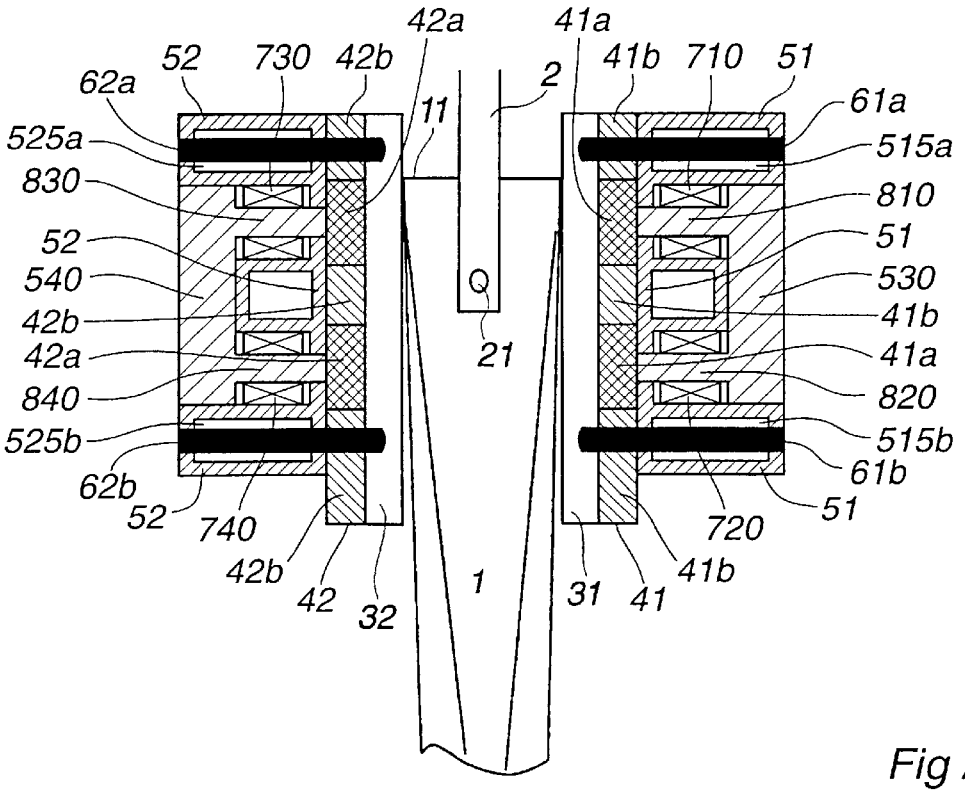
FIG. 2 shows a schematic vertical cross section through a further embodiment where magnets are adapted to generate static or periodic low-frequency magnetic fields to act at two levels.
Figure 3:
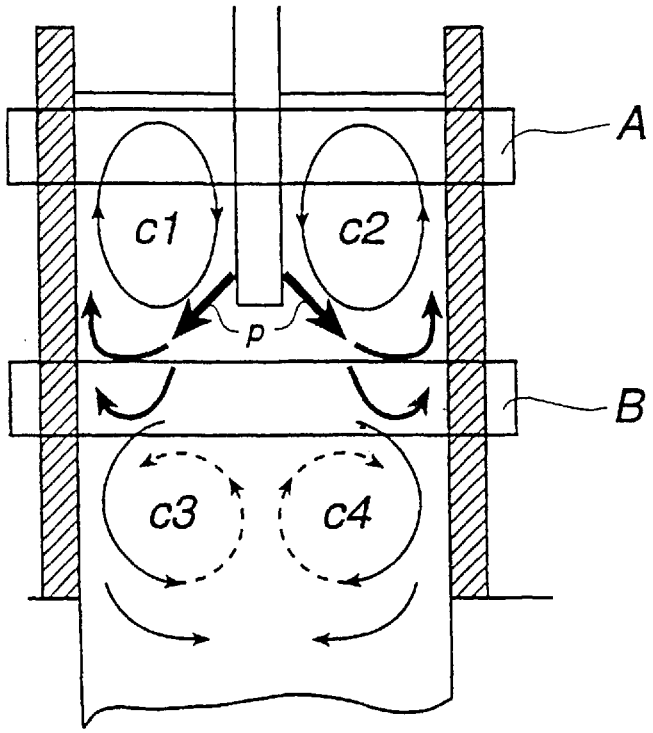
FIGS. 3 and 4 show the secondary flow obtained according to two examples of use of a device according to the invention, adapted to apply magnetic fields to act at two levels in the casting mould.
Figure 4:
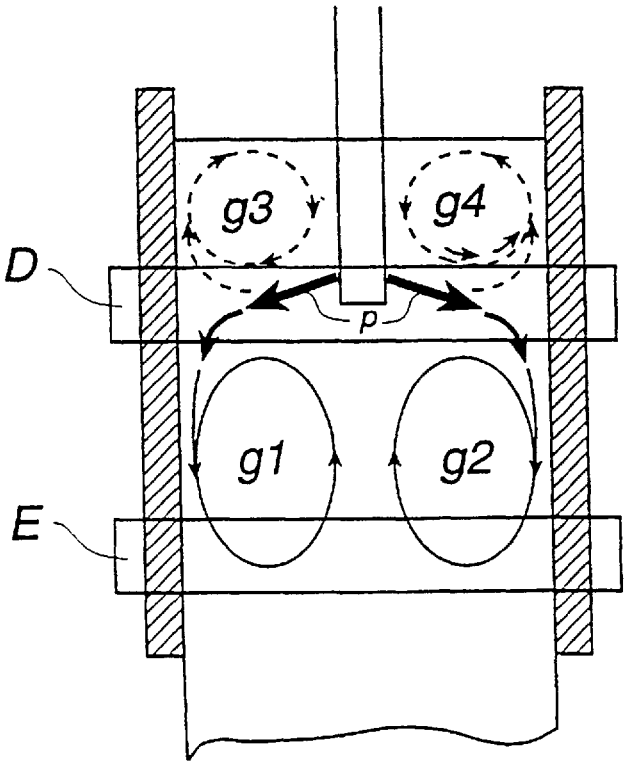

FIGS. 1 and 2 show moulds with casting moulds and water box beams disposed around the casting moulds and magnetic brakes integrated with the water box beams according to the invention. The casting mould in FIGS. 1 and 2, respectively, which is supplied with a primary flow of hot melt through a casting pipe 2, is a so-called slabs casting mould for casting of cast strands 1 in the form of so-called sheet blanks and comprises two larger copper plates 31, 32 constituting the long sides of the casting mould arranged with rectangular cross section. According to both embodiments, the casting mould comprises also two smaller copper plates constituting the short sides (not shown) of the casting mould. The copper plates 31, 32 in FIGS. 1 and 2 are each connected to a pole plate 41, 42. According to both embodiments, a pole plate 41, 42, which is primarily arranged to stiffen up a copper plate 31, 32, comprises sections 41*a,* 42*a* of magnetic material and sections 41*b,* 42*b* of non-magnetic material. By configuration of the magnetic sections 41*a,* 42*a,* the propagation, the direction and the magnetic field strength of the magnetic field in the casting mould, and in the cast strand 1 and/or melt present in the casting mould, are adjusted. In the two embodiments according to FIGS. 1 and 2, respectively, the pole plates 41, 42 each make contact with a water box beam 51*a,* 51*b,* 52*a,* 52*b.* A plurality of fixing screws 61*a,* 61*b,* 62*a,* 62*b* extend from the rear walls 510, 520 of the water box beams 51, 52, through the water box beams 51*a,* 51*b,* 52*a,* 52*b* and further through the pole plates 41, 42 into the copper plates 31, 32. Threads (not shown) in the fixing screws 61*a,* 61*b,* 62*a,* 62*b* cooperate with threads (not shown) in the copper plates 31, 32 for fixing. Through the fixing screws 61*a,* 61*b,* 62*a,* 62*b,* the pole plates 41, 42 and the copper plates 31, 32 are fixed to each other and to the water box beams 51, 52. Cooling channels (not shown) are provided in the copper plates 31, 32. The cooling channels communicate via upper and lower flow passages (not shown) in the pole plates 41, 42 with upper and lower box-shaped cavities 515*a,* 525*a,* and 515*b,* 525*b,* respectively, in the water box beams 51, 52. Further, the upper 515*a,* 525*a* and lower 515*b,* 525*b* cavities communicate with each other, in a manner not shown. In this way, cooling water circuits are formed in each mould half. During the casting, water is pumped around in the cooling water circuits for cooling of the copper plates and indirectly of the melt. The magnetic brakes shown in FIGS. 1 and 2 are both electromagnetic brakes which generate magnetic fields to act across the casting direction to brake and split up the flow of hot melt supplied to the casting mould through the casting pipe, and to check the secondary flow thus arising in the casting mould. The magnetic field or fields are static or periodic low-frequency fields. An electromagnetic brake included in the device according to FIG. 1 comprises electromagnets, placed on two confronting sides of the casting mould, in the form of energized coils 71, 72, 710, 720, 730, 740 with magnetic cores of magnetically conducting material. The magnetic cores in FIG. 1 are included in cores 81, 82, of magnetically conducting material comprising the part arranged in the coil, the magnetic core and a front piece making contact with a pole plate 41, 42 to transmit the magnetic field generated by the magnet to the pole plate 41, 42 and further into the casting mould and the melt arranged there. To constitute a magnetic circuit with magnetic flux balance, the electromagnetic brake should also comprise a magnetic return path, usually called a magnetic yoke. The brakes shown in FIG. 1 and FIG. 2 comprise a magnetic return path in the form of a part 510, 520, 530, 540 made of a magnetic material and integrated into the water box beam. In FIG. 1, the magnetically conducting part of the water box beam 51, 52 is made up of a rear wall 510, 520 and this part is arranged with good magnetic contact with the core 81, 82. As is clear from FIG. 1, no part of the brake projects outside any of the outer limiting surfaces of the water box beams 51, 52. The coils 71, 72 included in the brake are arranged in coil spaces 91, 92. The coil spaces 91, 92 are arranged as recesses in the water box beams 51, 52. The recesses or the coil spaces 91, 92 in the water box beams are arranged so as to be closed by the pole plates 41, 42. When removing a pole plate 41, 42, the coil space 91, 92 is opened, whereby the coil 71, 72 is exposed for, for example, replacement or service. In embodiments where pole plates are not used, it is the copper plate 31, 32 that closes the coil space 91, 92. In certain embodiments of a device according to the invention, the coils 71, 72 are placed, as in FIG. 2, between the water box beams 51, 52 and the copper plates 31, 32 of the casting mould. According to the embodiment shown in FIG. 1, the cores 81, 82 are fixedly integrated with the rear walls 510, 520 of the water box beams, which walls are included as yokes in the magnetic brake. In other alternative embodiments, the cores 81, 82 are arranged as separate parts which are inserted into cavities provided for the purpose in the water box beams 51, 52. It is then required that the cores 81, 82 are kept in good magnetic contact with that part of the water box beam 510, 520 which is included, as a magnetic yoke, in the magnetic brake. Of course, embodiments may also be used in which the cores 81, 82 are fixedly integrated into the water box beam 51, 52 but not formed in one and the same piece as the yoke 510, 520. FIG. 2 shows an embodiment with coils 710, 720, 730, 740 and cores 810, 820, 830, 840 at two levels one after the other in the casting direction. According to the brake in FIG. 2, the cores 810, 820, 830, 840 are connected to magnetic return paths arranged between the cores 810, 820 and 830, 840 on respective sides of the casting mould. These magnetic return paths include those parts of the water box beams 530, 540 which are made of magnetic material. The brake shown in FIG. 2 is provided with the coils 710, 720, 730, 740 in recesses in the water box beams 51, 52 in the same way as is shown in FIG. 1. It is especially advantageous to use a brake according to FIG. 2 to generate static or periodic low-frequency magnetic fields to act at two levels within a casting mould during closed casting. By closed casting is meant that melt is supplied to the casting mould through a casting pipe with one or more openings 21, opening out below the upper surface 11, the meniscus, of the melt. Depending on other parameters such as the dimensions of the cast strand, the casting rate and any gas flow supplied, for various reasons, to the primary flow of supplied melt in the casting pipe, these magnetic fields are disposed at different levels relative to the meniscus 11 and the openings 21 of the casting pipe to achieve secondary flows in the mould, preferably stable and circulating secondary flows which ensure a good separation of any particles entering with the steel, good thermal conditions in the cast strand to ensure the desired casting structure.

According to a first alternative use of a brake, which is adapted to act at two levels arranged one after the other in the casting direction, the magnets are disposed to generate a first magnetic field A which acts at a level at the meniscus or at a level between the meniscus and the openings of the casting pipe, and further magnets adapted to act in at least one magnetic field B at a level downstream of the openings of the casting pipe. This location of the magnets provides a significant circulating secondary flow C1 and C2 in the upper part of the cast strand between the two levels mentioned. The secondary flow is in this case characterized in that the primary flow P of melt is braked and split up into secondary flows, which by cooperation of the magnetic forces and the electric currents induced in the melt give rise to the circulating secondary flows C1 and C2 in the region between the two levels, that is, in the upper part of the casting mould. Depending on the other casting parameters, the secondary flow downstream of the openings of the casting pipe will be directed towards the centre of the cast strand, or in certain cases also circulating. With this location, circulating secondary flows c3 and c4 downstream of the openings of the casting pipe will not be as stable as the circulating secondary flows C1 and C2 in the upper parts of the mould. According to a second alternative use of a brake according to FIG. 2, also during closed casting, the magnets are adapted to generate at least one first magnetic field at a level D at the openings 21 of the casting pipe and further magnetic fields to act at a level E downstream of the openings of the casting pipe. By this location of the levels, a good braking of the primary flow P of incoming melt is obtained in combination with stable secondary flows G1 and G2 in the region between the levels D, E, that is, in the lower part of the mould downstream of the openings 21 of the casting pipe. The stable secondary flows G1 and G2 are in this case supplemented by smaller stable secondary flows g3 and g4 in the upper part of the mould, that is, above the first level D.

What is claimed is:

1. A device, for continuous or semicontinuous casting of metal in a casting mould, of braking and splitting up a primary flow of hot melt supplied to the casting mould, and controlling the flow of melt in non-solidified portions of a cast strand, wherein the cast strand is formed during the passage through the casting mould which is cooled and open In both ends of the casting direction, the device comprises:

a plurality of water box beams arranged around the casting mould to support and cool the casting mould and to supply a coolant to the casting mould and a magnetic brake, said magnetic brake is adapted to generate at least one static or periodic low-frequency magnetic field to act in the path of the inflowing melt, said magnetic brake comprises at least one magnet for generating the magnetic field, at least one core for transmitting the magnetic field generated by the magnet to the casting mould and the cast strand, and at least one magnetic return path, the magnetic circuit comprises the casting mould and the cast strand, wherein the water box beams, at least in part, comprise a magnetically conducting material, the magnet is arranged in a recess in a water box beam, the magnetically conducting material is adapted to be part of the magnetic return path, and the magnet and the magnetic return path are Integrally arranged into the water box beam such that the magnet and the magnetic return path, in their entirety, are inside the rear wall of the water box beam.

2. A device according to claim 1, wherein the magnet is an electromagnet supplied with electric direct current or low-frequency alternating current and comprising an energized coil arranged around a magnetic core of a magnetically conducting material.

3. A device according to claim 1, wherein cooling means for cooling of the casting mould, which at least comprise cooling channels included in the water box beams, are also adapted to cool the magnets.

4. A device according to claim 1, wherein a plate, which completely or partially comprises a magnetic material, a so-called pole plate, is arranged between the casting mould and the core to influence the propagation, the direction and the magnetic field strength of the magnetic field in the casting mould and the cast strand present in the casting mould.

5. A device according to claim 4, wherein one side of the pole plate, is detachably connected to the water box beam that its opposite side is connected to the casting mould and that the magnet is so arranged in the water box beam that, when removing the pole plate, the coil is exposed.

6. A device according to claim 4 wherein wherein the pole plate comprises sections of a magnetic material and sections of a non-magnetic material whereby the sections of magnetic material constitute magnetic windows for controlling the propagation, the direction and the magnetic field strength of the magnetic field in the casting mould and the cast strand present in the casting mould.

7. A device according to claim 1, wherein the core comprises sections of a magnetic material and sections of a non-magnetic material, at least some of the core sections being detachably arranged to make possible variation of the propagation and strength of the magnetic field.

8. A device according to claim 1, wherein a frame structure is arranged to support the water box beams and the casting mould.

9. A device according to claim 8, wherein the frame structure, at least partly, comprises magnetic material adapted to form part of the magnetic return path.

10. A device according to claim 1, wherein magnets are adapted to generate two or more static or periodic low-frequency magnetic fields to act at the same level across the casting direction in the casting mould.

11. A device according to claim 1, wherein magnets are adapted to generate static or periodic low-frequency magnetic fields to act at least two levels A, B and D, E, respectively, disposed one after the other in the casting direction, within the casting mould.

12. Use of a device according to claim 11 during casting in a casting mould wherein the casting mould is supplied with melt by means of a casting pipe with one or more openings opening out below the upper surface of the melt, the meniscus wherein one or more magnets are adapted to generate at least one magnetic field at a first level A, which is adapted to act at the meniscus or in the region between the meniscus and the openings of the casting pipe, and at least one additional magnetic field to act at one or more levels B downstream of the openings of the casting pipe.

13. Use of a device according to claim 11 during casting in a casting mould wherein the casting mould is supplied with melt by means of a casting pipe with one or more openings opening out below the upper surface of the melt, the meniscus wherein one or more magnets are adapted to generate at least one magnetic field at a first level D, which is adapted to act at the openings of the casting pipe, and at least one additional magnetic field to act at one or more levels E downstream of the openings of the casting pipe.

14. A device according to claim 1, wherein:

the magnetically conducting material is adapted to be part of the core.

* * * * *